US007291030B2

(12) United States Patent
Mohs

(10) Patent No.: US 7,291,030 B2
(45) Date of Patent: Nov. 6, 2007

(54) ZERO INSERTION FORCE ELECTRICAL CONNECTOR PIECE

(75) Inventor: Wolfgang Mohs, Iserlohn (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 11/527,049

(22) Filed: Sep. 25, 2006

(65) Prior Publication Data

US 2007/0099508 A1 May 3, 2007

Related U.S. Application Data

(63) Continuation of application No. PCT/EP2005/003222, filed on Mar. 26, 2005.

(30) Foreign Application Priority Data

Mar. 30, 2004 (DE) ..... 10 2004 015 344

(51) Int. Cl.
*H01R 13/15* (2006.01)
*H01R 13/62* (2006.01)

(52) U.S. Cl. ..... 439/263; 265/748

(58) Field of Classification Search ..... 439/263, 439/265, 262, 259, 268, 851, 635
See application file for complete search history.

(56) References Cited

U.S. PATENT DOCUMENTS 3,491,329 A * 1/1970 Lecocq ..... 439/263
3,710,304 A * 1/1973 Warner et al. ..... 439/346
4,023,881 A * 5/1977 Migneau ..... 439/261
6,083,023 A 7/2000 Kamath
6,244,885 B1 6/2001 Iwahori
7,232,323 B2 * 6/2007 Mohs et al. ..... 439/265

FOREIGN PATENT DOCUMENTS

| | | |
|---|---|---|
| DE | 24 32 222 | 2/1975 |
| DE | 89 07 845 U | 8/1989 |
| DE | 44 09 229 A1 | 9/1995 |
| DE | 197 42 400 A1 | 4/1999 |
| JP | 5062740 | 3/1993 |

* cited by examiner

*Primary Examiner*—Hae Moon Hyeon
(74) *Attorney, Agent, or Firm*—Brooks Kushman P.C.

(57) ABSTRACT

A zero insertion force electrical connector part includes a sleeve contact (socket contact) and an activation element associated with the sleeve contact. The sleeve contact has contact members with a plug contact receptacle situated between the contact members for receiving an electrical plug contact. Each contact member has a contact region. The activation element is enclosed around the contact members. The activation element is displaceable relative to the sleeve contact between non-activated and activated positions. The activation element applies a contact force to the contact members of the sleeve contact which forces the contact regions against a plug contact inserted into the plug contact receptacle of the sleeve contact to make contact with the plug contact while the activation element is in the activated position.

15 Claims, 3 Drawing Sheets

ZERO INSERTION FORCE ELECTRICAL CONNECTOR PIECE

CROSS-REFERENCE TO RELATED APPLICATIONS

This is a continuation of International Application PCT/EP2005/003222, published in German, with an international filing date of Mar. 26, 2005, which claims priority to DE 10 2004 015 344.2 filed Mar. 30, 2004, the disclosures of which are both hereby incorporated by reference.

BACKGROUND OF THE INVENTION

1. Field of the Invention

The present invention relates to zero insertion force electrical connectors.

2. Background Art

Zero insertion force connectors are plug-in connectors used in electronic devices for contacting individual modules, flexible films, and printed circuit boards. The terms "zero insertion force connector" and "zero insertion force connector piece" are used because the plug-in connector parts of these connectors may be contacted with application of relatively little force.

DE 197 42 400 A1 describes a zero insertion force connector for connecting two printed circuit boards. This connector includes a receptacle for inserting the edge of the first circuit board to be contacted. The first board is introduced into an insertion slot in the connector. The connector has two connector portions which swivel toward and away from one another. The second circuit board to be contacted is inserted in a position of the connector portions in which the connector portions are away from one another. After the second board is inserted, a safety lock is moved to swivel the connector portions back toward one another to achieve the desired contacting of the conductors of the second board. This zero insertion force connector is not suitable for producing a multi-pole, plug-in connector such as a multi-row, plug-in connector.

Multi-pole, plug-in connectors are used, for example, in the automotive field for contacting control devices or connecting electronic modules integrated into an instrument panel with a vehicle electrical system. Due to the multi-pole nature of these connectors, it is desirable for these connectors to have zero insertion force connector parts.

The force required to join multi-pole, complementary plug-in connector parts together is considerable. This is because for proper contacting, a relatively large contact force must be exerted by sleeve contacts on plug contacts inserted therein to ensure that contact is maintained under many different types of environmental conditions. To simplify the connection or joining of the plug-in connector parts, joining aids such as levers or the like are used by which two plug-in connector parts are connected by an appropriate application of force. However, in many locations inside a vehicle in which such plug-in connector parts are connected to one another, there is not enough installation space available to accommodate or operate such assembly aids.

SUMMARY OF THE INVENTION

An object of the present invention is a multi-pole zero insertion force electrical connector part.

Another object of the present invention is a zero insertion force electrical connector having two multi-pole, plug-in, zero insertion force electrical connector parts.

Another object of the present invention is a zero insertion force electrical connector having two multi-row, plug-in, zero insertion force electrical connector parts.

In carrying out the above objects and other objects, the present invention provides a zero insertion force electrical connector part. The connector part includes a sleeve contact (socket contact) and an activation element associated with the sleeve contact. The sleeve contact has contact members with a plug contact receptacle situated between the contact members for receiving an electrical plug contact. Each contact member has a contact region. The activation element is enclosed around the contact members. The activation element is displaceable relative to the sleeve contact between non-activated and activated positions. The activation element applies a contact force to the contact members of the sleeve contact which forces the contact regions against a plug contact inserted into the plug contact receptacle of the sleeve contact to make contact with the plug contact while the activation element is in the activated position.

In carrying out the above objects and other objects, the present invention provides a zero insertion force electrical connector. The connector includes first and second plug-in connector parts. The connector parts are connected to one another in a longitudinal direction. The second connector part has a sleeve contact and an activation element. The sleeve contact has contact members with a plug contact receptacle situated between the contact members for receiving an electrical plug contact. Each contact member has two contact regions. The activation element is movably connected to the contact members of the sleeve contact such that the activation element is longitudinally displaceable relative to the sleeve contact between non-activated and activated positions. The activation element applies a contact force to the contact members which forces the contact regions against a plug contact inserted into the plug contact receptacle of the sleeve contact to make contact with the plug contact while the activation element is in the activated position.

In an embodiment, a zero insertion force electrical connector part includes a sleeve contact (i.e., contact socket) for accommodating a complementary electrical plug contact. The sleeve contact has a contact region(s). An activation element is associated with the sleeve contact. The activation element is adjustable relative to the sleeve contact between a non-activated position and an activated position. The activation element adjusts between the non-activated and activated positions relative to the sleeve contact by being longitudinally displaced with respect to the sleeve contact. In the activated position, the activation element applies the required contact force to the contact region(s) of the sleeve contact to establish electrical and mechanical contact between the sleeve contact and a plug contact inserted in the sleeve contact. In the non-activated position, the activation element lifts away the contact region(s) of the sleeve contact from the surface of a plug contact inserted into the plug receptacle of the sleeve contact to thereby separate the contact region(s) from the plug contact. As such, in the non-activated position of the activation element, a plug contact may be inserted into the plug receptacle of the sleeve contact with relatively little (e.g., "zero") force.

In an embodiment, a zero insertion force electrical connector part is a multi-pole, plug-in connector part which includes multiple sleeve contacts (i.e., contact sockets).

Each sleeve contact has several contact regions. Each contact region is a contact bulge and/or a contact bead. Each sleeve contact has a plug contact receptacle situated between the contact regions for receiving a respective electrical plug contact. The plug contacts are preferably in the form of blade contacts. Activation elements are respectively associated with the sleeve contacts. The activation elements are adjustable relative to their respective sleeve contact between an activated position and a non-activated position. The adjustability between an activation element and a sleeve contact is achieved, for example, by a relative longitudinal displaceability between the activation element and the sleeve contact.

The activation element for a sleeve contact is used to apply a contact force for proper contacting of a plug contact inserted in the plug contact receptacle of the sleeve contact to the contact regions of the sleeve contact. The activation element applies the contact force to the contact regions of the sleeve contact when the activation element is in the activated position. If the activation element is not activated (i.e., the activation element is in the non-activated position), the force applied by the activation element for proper contacting does not act on the contact regions of the sleeve contact. That is, in the non-activated position, the activation element lifts away the contact regions of the sleeve contact from the plug receptacle of the sleeve contact. As a result, a plug contact may be inserted into the sleeve contact with relatively little (e.g., "zero") force when the activation element is not activated.

In an embodiment, the activation element is configured such that in its non-activated position the contact region(s) of a sleeve contact are lifted from the electrical surface of a plug contact inserted or being inserted into the plug receptacle of the sleeve contact. The activation element does not activate to apply the desired contact force to the contact region(s) of a sleeve contact until a plug contact has been properly inserted into the plug receptacle of the sleeve contact.

In an embodiment, the activation of the activation element is coupled to the insertion motion of a plug contact into the plug receptacle of the sleeve contact associated with the activation element. In an embodiment, the activation element is actuated together with a secondary lock.

The activation elements of a multi-pole, zero force insertion electrical connector part in accordance with an embodiment of the present invention may be mutually actuated without a great exertion of force. This is a result of inclined positioning surfaces between the activation elements and the associated sleeve contacts. Alternatively, this is a result of positioning cams advantageously associated with the activation elements and the associated sleeve contacts. The individual association of an activation element with a sleeve contact allows individual rows of activation elements, or individual groups of sleeve contacts, to be mutually activated.

In an embodiment, a sleeve contact (i.e., a contact socket) includes two contact members oppositely situated with respect to the plug receptacle of the sleeve contact. Each contact member has two adjacent contact regions. A contact member section separates the contact regions from one another. The contact member section bulges outward relative to the activation element. Obliquely extending surfaces of the bulge are used as positioning bevels for a positioning cam of the activation element. The positioning cam acts on the middle region of the bulge in the activated position of the activation element to thereby enable the activation element to apply the desired contact force to the contact regions.

In an embodiment, the activation element is a sheet metal part and the sides of the activation element facing the plug receptacle include an electrically insulating coating.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
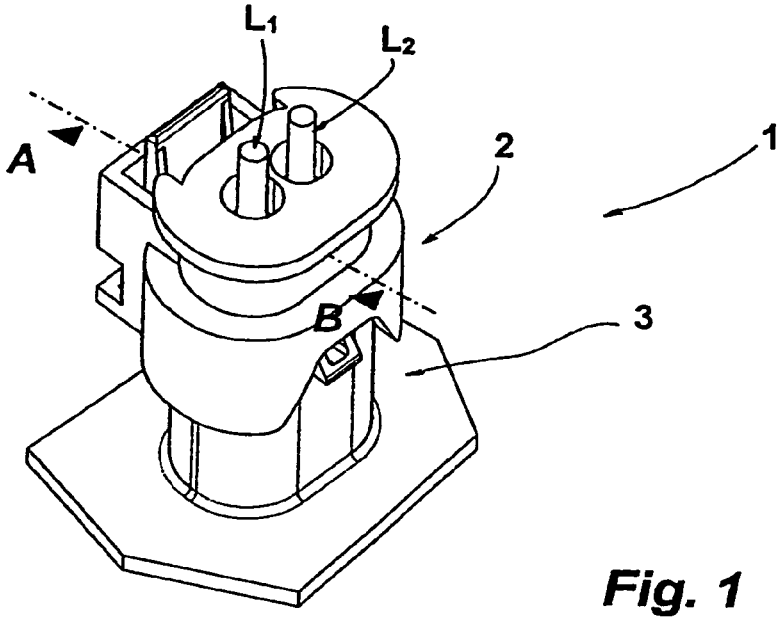
FIG. 1 illustrates a perspective view of a zero insertion force electrical connector having first and second zero insertion force electrical connector parts in accordance with an embodiment of the present invention.

Referring now to FIG. 1, a perspective view of a zero insertion force electrical connector 1 in accordance with an embodiment of the present invention is shown. Connector 1 is a multi-pole, plug-in connector. Connector 1 includes first and second zero insertion force electrical connector parts 2, 3. Connector parts 2, 3 are complementary to one another such that the connector parts may be electrically and mechanically connected to one another to form connector 1. Each of connector parts 2, 3 is a multi-pole, plug-in connector part having two poles. First connector part 2 is a socket part. Second connector part 3 bears electrical plug contacts. In this embodiment, second connector part 3 is integrally molded onto the outer wall of a control device. As shown in FIG. 1, first and second connector parts 2, 3 are connected to one another thereby forming connector 1.

Figure 2A:
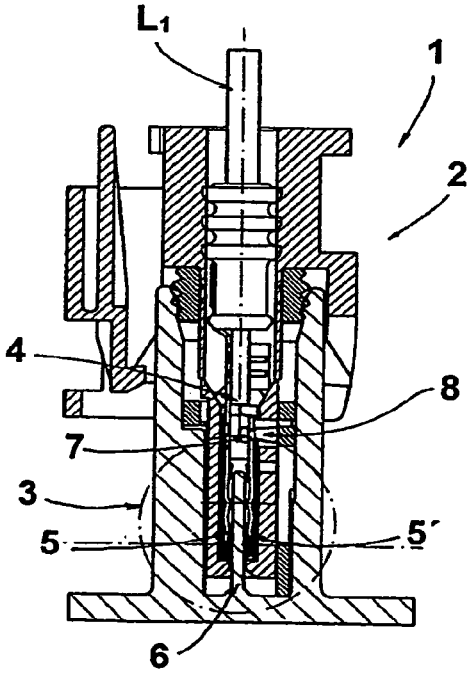
FIG. 2*a* illustrates a section of the zero insertion force electrical connector along line A-B of FIG. 1.
Figure 2B:
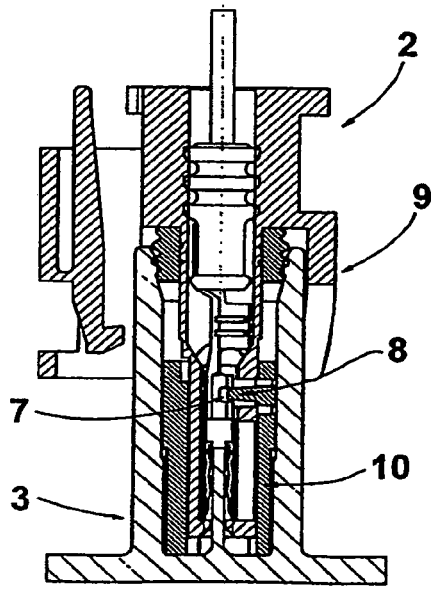
FIG. 2*b* illustrates a section of the zero insertion force electrical connector along line A-B of FIG. 1 in a parallel sectional plane relative to FIG. 2*a;*

Referring now to FIGS. 2A and 2B, with continual reference to FIG. 1, sectional views of connector 1 along the line A-B of FIG. 1 are shown. First and second electrical conductors L1, L2 extend through respective poles of first connector part 2 and into second connector part 3. The rear ends of conductors L1, L2 lead out from back side of first connector part 2 through the respective poles of the first connector part. The front ends of conductors L1, L2 extend into second connector part 3 and electrically connect to the top ends of respective sleeve contacts (i.e., contact sockets) 4 of the second connector part.

Each sleeve contact 4 is configured the same and, as such, the description of the sleeve contact configuration will be given with reference to one sleeve contact. Sleeve contact 4 includes two contact members 5, 5' situated below the top end of the sleeve contact. A plug contact receptacle of sleeve contact 4 is situated between contact members 5, 5'. An electrical plug contact 6 of second connector part 3 inserts into the plug contact receptacle of sleeve contact 4. In an embodiment, plug contact 6 is a blade contact.

In its section adjacent to contact members 5, 5' and connecting same to one another, sleeve contact 4 has a primary locking recess 7 in which a locking pin 8 engages (best shown in FIG. 2*b*). Locking pin 8 is part of an insert 10 included in a housing 9 of first connector part 2.

Figure 3:
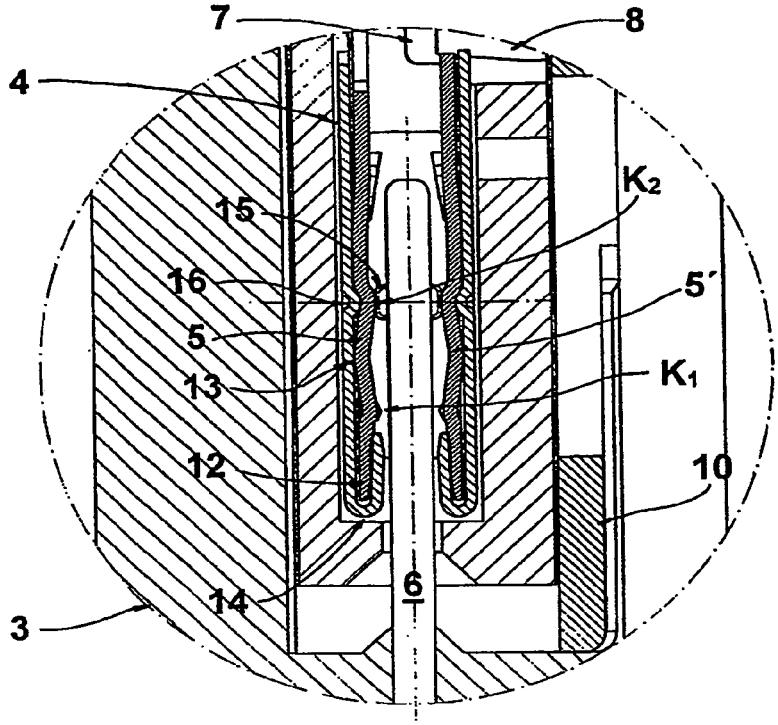
FIG. 3 illustrates an enlarged view, corresponding to the dotted circle of FIG. 2*a*, of the contacting region of the zero insertion force electrical connector with the activation element associated with the sleeve contact of the second zero insertion force electrical connector part being in the non-activated position.

Referring now to FIG. 3, with continual reference to FIGS. 1, 2*a*, and 2*b*, an enlarged view, corresponding to the dotted circle of FIG. 2*a*, of the contacting region of connector 1 is shown. An activation element 11 is associated with sleeve contact 4. Activation element 11 has the form of an overspring and may be a sheet metal part. Activation element 11 encloses contact members 5, 5' of sleeve contact 4 like a cage. Activation element 11 is longitudinally displaceable relative to sleeve contact 4 between a non-activated position and an activated position. FIG. 3 illustrates activation element 11 in the non-activated position.

Contact members 5, 5' have an identical design. As such, with regard to its overspring characteristics relative to contact members 5, 5', activation element 11 likewise has the same design on each of its two sides which cooperate with respective contact members 5, 5'. The description below addresses contact member 5 and the section of activation element 11 associated therewith. The description in this regard correspondingly applies to contact member 5' and the section of activation element 11 associated therewith.

Contact member 5 includes first and second contact regions K1, K2. Each contact region K1, K2 is formed by a bulge bearing a contact bead. Contact regions K1, K2 are used for contacting the surface of plug contact 6 inserted into the plug contact receptacle of sleeve contact 4 to thereby electrically connect sleeve contact 4 and plug contact 6. As such, upon at least one of contact regions K1, K2 contacting the surface of plug contact 6 when conductor L1 is electrically connected to sleeve contact 4, plug contact 6 electrically connects to conductor L1 via sleeve contact 4.

Contact region K1 is located at the lower end of contact member 5 so as to leave a positioning extension 12 of contact member 5. Contact region K2 is situated at a distance above contact region K1. An outward bulge 13 is between contact regions K1, K2. Outward bulge 13 is formed by two surfaces inclined at an angle with respect to the apex of bulge 13. The first surface of bulge 13 inclines from the apex of bulge 13 to meet contact region K1. The second surface of bulge 13 inclines from the apex of bulge 13 to meet contact region K2.

Activation element 11 has on its lower end a U-shaped positioning clip 14. Positioning clip 14 engages behind positioning extension 12 of contact member 5. In the non-activated position of activation element 11, positioning clip 14 lifts contact member 5 together with its contact region K1 away from the surface of plug contact 6 inserted into the plug contact receptacle of sleeve contact. That is, in the non-activated position of activation element 11, positioning clip 14 lifts contact member 5 together with its contact region K1 away from the plug contact receptacle of sleeve contact 4.

Another positioning clip 15 is used to lift contact region K2 away from the surface of plug contact 6 when activation element 11 is in the non-activated position. Positioning clip 15 represents a U-shaped bevel of activation element 11. Positioning clip 15 guides around and behind contact member 5 to be placed between the side of contact member 5 facing plug contact 6 and plug contact 6. In the non-activated position of activation element 11, positioning clip 15 is located directly adjacent to contact region K2 between contact region K2 and the plug contact receptacle of sleeve contact 4. As such, in the non-activated position of activation element 11, positioning clip 15 separates contact region K2 away from plug contact 6 inserted into the plug contact receptacle of sleeve contact 4. That is, in the non-activated position of activation element 11, positioning clip 14 separates contact member 5 together with its contact region K2 further from the plug contact receptacle of sleeve contact 4.

Positioning clips 14, 15 have an electrically insulating coating on their surfaces facing plug contact 6 such that sleeve contact 4 and plug contact 6 electrically connect to one another only when activation element 11 is activated.

Activation element 11 includes a positioning cam 16. Positioning cam 16 is situated opposite from positioning clip 15 and rests against the other top side of contact member 5 such that positioning cam 16 and positioning clip 15 sandwich contact region K2 when activation element 11 is in the non-activated position.

Plug contact 6 is pushed into the plug contact receptacle between contact members 5, 5' of sleeve contact 4 while activation element 11 is in the non-activated position. As contact members 5, 5' do not contact plug contact 6 while activation element 11 is in the non-activated position, connector parts 2, 3 may be connected together to form connector 1 without a great exertion of force. Force required for the connection between connector parts 2, 3 results from placing the seals into their respective seats. As such, second connector part 3 is referred to as a zero insertion force electrical connector part.

Figure 4A:
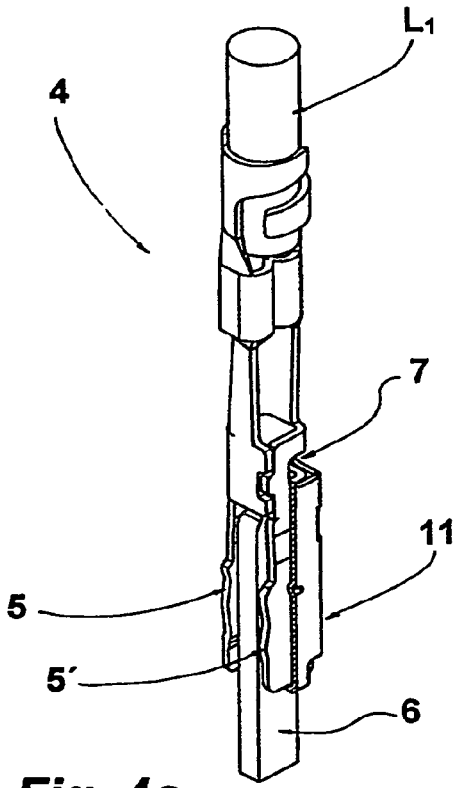
FIG. 4*a* illustrates a perspective view of the sleeve contact with the activation element thereof in the non-activated position.
Figure 4B:
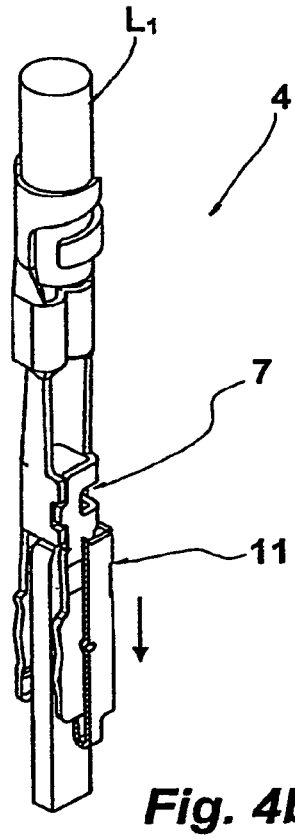
FIG. 4*b* illustrates a perspective view of the sleeve contact with the activation element thereof in the activated position.

Referring now to FIGS. 4*a* and 4*b*, perspective views of sleeve contact 4 with activation element 11 thereof are shown. FIG. 4*a* illustrates sleeve contact 4 with its associated activation element 11 connected thereto in the non-activated position, which corresponds to FIG. 3 as described above. FIG. 4*b* illustrates sleeve contact 4 with its associated activation element 11 connected thereto in the activated position, which corresponds to FIG. 5 as described below. As shown, activation element 11 has a cage-like body that is open on one side. Primary locking recess 7 which with its section adjoining contact members 5, 5' is introduced into sleeve contact 4.

Figure 5:
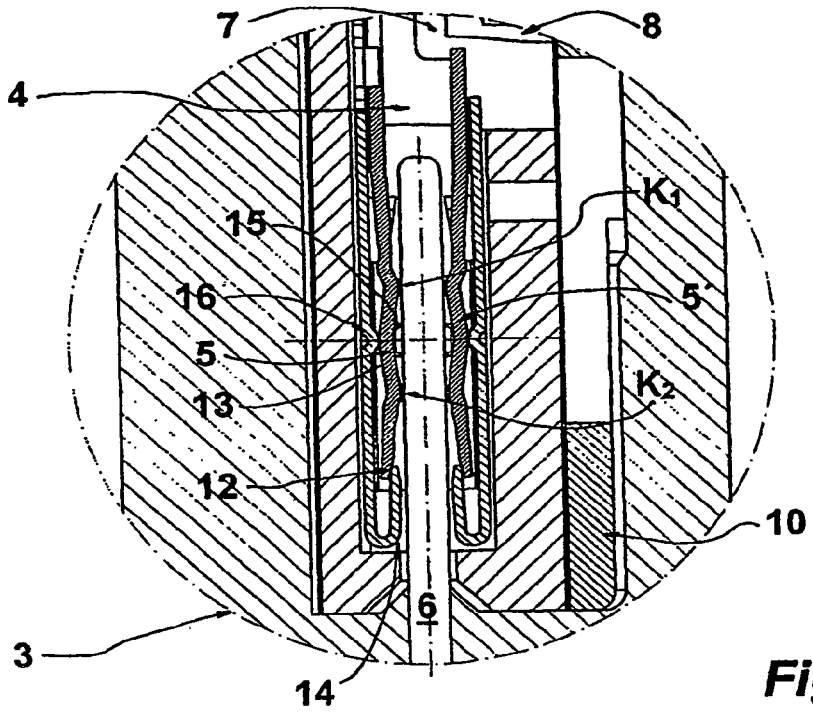
FIG. 5 illustrates an enlarged view, corresponding to the dotted circle of FIG. 2*a*, of the contacting region of the zero insertion force electrical connector with the activation element associated with the sleeve contact of the second zero insertion force electrical connector part being in the activated position and the first and second zero insertion force electrical connector parts being in their electrically contacting position relative to one another.

Referring now to FIG. 5, with continual reference to FIGS. 1, 2*a*, 2*b*, 3, 4*a*, and 4*b*, an enlarged view, corresponding to the dotted circle of FIG. 2*a*, of the contacting region of connector 1 is shown. FIG. 5 illustrates activation element 11 in the activated position. FIG. 5 further illustrates first and second connector parts 2, 3, being in their electrically contacting position relative to one another to form connector 1.

To apply the desired contact force for contacting contact members 5, 5' of sleeve contact 4 to a plug contact 6 inserted into the plug contact receptacle of sleeve contact 4, activation element 11 is longitudinally displaced relative to contact members 5, 5' in the direction of insertion of first connector part 2 into second connector part 3 to be in the activated position. The arrow in FIG. 4*b* indicates this direction. This is achieved in the course of a final lift for joining connector parts 2, 3. Locking pin 8, which engages with primary locking recess 7, is used to secure contact socket 4 in place while activation element 11 is pushed further with respect to insert 10 bearing locking pin 8 toward second connector part 3.

In this relative motion between activation element 11 and contact members 5, 5' of sleeve contact 4, positioning cam 16 is pushed over the inclined surfaces forming bulge 13 up to the apex of bulge 13. In this respect the inclined surfaces act as positioning surfaces. In this motion, positioning clips 14, 15 respectively move away from contact regions K1, K2 so that the force, exerted by positioning cam 16 supported on the backside of insert 10, on the apex of bulge 13 acts on contact regions K1, K2 to achieve the desired contacting with the surface of plug contact 6, as shown in FIG. 5.

Contact members 5, 5' together with their contact regions K1, K2 resting on the top side of plug contact 6 are illustrated in FIG. 5. The inclination of the positioning surfaces of bulge 13 is designed in such a way that positioning cam 16 may be pushed into its activated position of activation element 11 without great exertion of force.

First connector part 2 detaches from second connector part 3 in the reverse sequence, whereby activation elements 11 are first pulled back to the non-activated position (shown in FIG. 3) before plug contacts 6 are pulled out of respective contact sockets 4 by pulling first connector part 2 from second connector part 3.

Figure 6A:
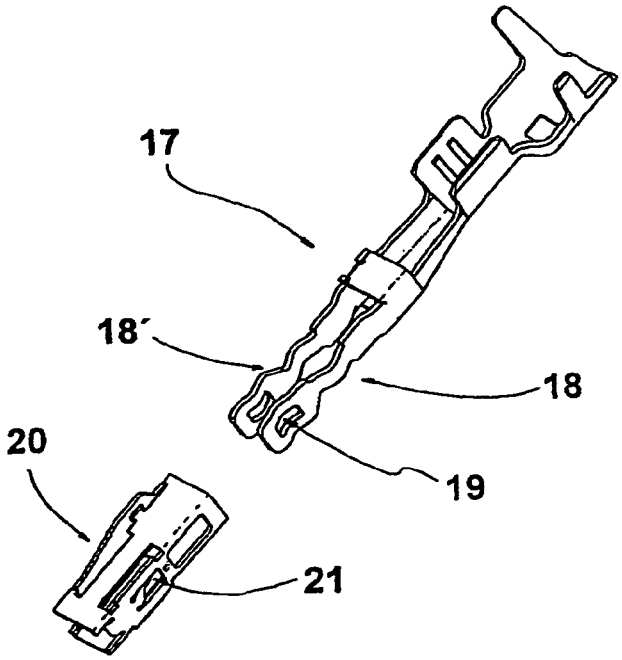
FIG. 6*a* illustrates an exploded perspective view of a sleeve contact and its associated activation element in accordance with another embodiment of the present invention.
Figure 6B:
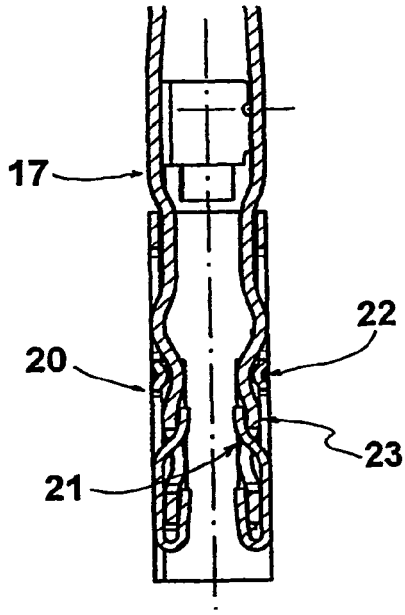
FIG. 6*b* illustrates a longitudinal sectional view of the sleeve contact and the activation element shown in FIG. 6*a*.

Referring now to FIGS. 6*a* and 6*b*, a sleeve contact 17 and its associated activation element 20 in accordance with another embodiment of the present invention are shown. FIG. 6*a* illustrates an exploded perspective view of sleeve contact 17 and its associated activation element 20. FIG. 6*b* illustrates a longitudinal sectional view of sleeve contact 17 and activation element 20. Sleeve contact 17 and its associated activation element 20 are for use in a zero insertion force connector part in accordance with another embodiment of the present invention.

Sleeve contact 17 has the same basic design as sleeve contact 4. Sleeve contact 17 differs from sleeve contact 4 in that two contact members 18, 18' of sleeve contact 17 each have an opening 19 in their front region. Openings 19 separates the two contact regions of contact members 18, 18' from one another. Activation element 20 has the basic design as activation element 11, but includes a positioning extension 21 designed as a clip. Positioning extension 21 passes through openings 19 in contact members 18, 18', thereby lifting the rear contact region of contact members 18, 18' in the non-activated position of activation element 20 from the surface of a plug contact inserted into the plug contact receptacle of sleeve contact 17.

FIG. 6*b* illustrates the non-activated position of activation element 20 with respect to sleeve contact 17. Positioning extension 21 of activation element 20 engages behind contact member 18. The front contact region of contact member 18 forms a positioning clip as the result of a U-shaped bevel on the front side, as described for activation element 11. Longitudinal displacement of activation element 20 causes the contact regions of contact members 18, 18' to be brought into contact with the surface of a plug contact 6 inserted into the plug contact receptacle of sleeve contact 17. In this embodiment as well, the contact force results from a positioning cam 22, respectively supported on the back side, which acts on a bulge 23 for each contact member 18, 18'.

The description of the zero insertion force electrical connector in accordance with embodiments of the present invention makes it clear that the sleeve contacts may be individually activated as a result of the activation elements being respectively associated with the sleeve contacts. However, the activation elements may be simultaneously activated. The zero insertion force electrical connector is suited for forming multi-pole, plug-in connector parts, in particular those which include multiple pole rows. Activation of the activation elements may be triggered by the connector part joining process as well as by actuation of an additional element, for example, a secondary lock.

Furthermore, it is particularly advantageous that the activation element is not larger than conventional oversprings, thereby enabling the sleeve contacts together with their locking elements to be inserted into customary socket housings. In particular, the sleeve contacts bearing the locking elements are installed in the same way as for conventional sleeve contacts. This also means that the sleeve contacts are preferably mounted in their housing chamber in a floating manner to compensate for tolerances between the connector parts to be connected to one another. The possibility of applying a large contact force to the contact regions has the additional advantage that such a contact is a purely metallic contact. Any contaminating layers present on the mutually cooperating contacts may be reliably penetrated, enabling low currents and voltages to be safely conducted.

LIST OF REFERENCE NUMERALS

1 Zero insertion force electrical connector
2 First zero insertion force electrical connector part
3 Second zero insertion force electrical connector part
4 Sleeve contact (socket contact)
5, 5' Contact members
6 Plug contact
7 Primary locking recess
8 Locking pin
9 Housing
10 Insert
11 Activation element
12 Positioning extension
13 Bulge
14 Positioning clip
15 Positioning clip
16 Positioning cam
17 Sleeve contact
18, 18' Contact members
19 Openings
20 Activation element
21 Positioning extension
22 Positioning cam
23 Bulge
K1, K2 Contact regions
L1, L2 Conductors While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. A zero insertion force electrical connector part comprising:

a sleeve contact having contact members with a plug contact receptacle situated between the contact members for receiving an electrical plug contact, each contact member having at least one contact region; and an activation element enclosed around the contact members, wherein the activation element is displaceable relative to the sleeve contact between a non-activated position and an activated position, wherein the activation element applies a contact force to the contact members of the sleeve contact which forces the contact regions against the plug contact inserted into the plug contact receptacle of the sleeve contact to make contact with the plug contact while the activation element is in the activated position;

wherein the activation element separates the contact regions from the plug contact inserted into the plug contact receptacle of the sleeve contact while the activation element is in the non-activated position;

wherein the activation element includes positioning clips respectively associated with the contact regions of the sleeve contact, wherein the positioning clips lift away the associated contact regions from the plug contact inserted into the sleeve contact while the activation element is in the non-activated position.

2. The connector part of claim 1 wherein:

each positioning clip is electrically insulated on its side facing the plug contact receptacle of the sleeve contact.

3. A zero insertion force electrical connector part comprising:

a sleeve contact having contact members with a plug contact receptacle situated between the contact members for receiving an electrical plug contact, each contact member having at least one contact region; and an activation element enclosed around the contact members, wherein the activation element is longitudinally displaceable relative to the sleeve contact between a non-activated position and an activated position, wherein the activation element applies a contact force to the contact members of the sleeve contact which forces the contact regions against the plug contact inserted into the plug contact receptacle of the sleeve contact to make contact with the plug contact while the activation element is in the activated position;

wherein the sleeve contact includes two contact members oppositely situated with respect to a longitudinal axis of the sleeve contact, wherein the contact region of each contact member is a contact bend.

4. The connector part of claim 3 wherein:

the activation element separates the contact regions from the plug contact inserted into the plug contact receptacle of the sleeve contact while the activation element is in the non-activated position.

5. The connector part of claim 3 wherein:

each contact member includes first and second contact regions and a positioning extension, wherein the first and second contact regions are separate from one another by a longitudinal distance.

6. The connector part of claim 5 wherein:

the activation element includes a U-shaped positioning clip associated with the first contact region of a contact member, wherein the U-shaped positioning clip engages behind the positioning extension of the contact member.

7. The connector part of claim 5 wherein:

the contact members have openings in front of their second contact regions, facing the opening of the plug receptacle, through which an extension of the activation element passes as a positioning extension for the second contact region.

8. The connector part of claim 5 wherein:

each contact member includes a bulge between the contact regions of the contact member, the bulge faces the activation element;

wherein the activation element includes a positioning cam which is positioned so as to introduce the contact force via the bulge onto the contact members while the activation element is in the activated position.

9. A zero insertion force electrical connector comprising:

a first plug-in connector part; and a second plug-in connector part having a sleeve contact and an activation element, wherein the first and second plug-in connector parts are connected to one another in a longitudinal direction;

wherein the sleeve contact has contact members with a plug contact receptacle situated between the contact members for receiving an electrical plug contact, each contact member having two contact regions;

wherein the activation element is movably connected to the contact members of the sleeve contact such that the activation element is longitudinally displaceable relative to the sleeve contact between non-activated and activated positions, the activation element applying a contact force to the contact members which forces the contact regions against the plug contact inserted into the plug contact receptacle of the sleeve contact to make contact with the plug contact while the activation element is in the activated position.

10. The connector of claim 9 wherein:

the activation element moves to the activated position in response to the first plug-in connector part being connected to the second plug-in connector part in the longitudinal direction.

11. The connector of claim 9 wherein:

the activation element moves to the non-activated position in response to the first plug-in connector part being disconnected from the second plug-in connector part in a direction opposite to the longitudinal direction.

12. The connector of claim 9 wherein:

the activation element separates the contact regions from the plug contact inserted into the plug contact receptacle of the sleeve contact while the activation element is in the non-activated position.

13. The connector of claim 9 wherein:

each of the plug-in connector parts is a multi-pole, plug-in connector part.

14. The connector of claim 13 wherein:

each of the multi-pole, plug-in connector part is a multi-row, plug-in connector part.

15. The connector of claim 9 wherein:

each contact member includes first and second contact regions separate from one another by a longitudinal distance.

* * * * *